US009441621B2

(12) United States Patent
Yoo et al.

(10) Patent No.: US 9,441,621 B2
(45) Date of Patent: Sep. 13, 2016

(54) MACHINE INCLUDING COMPRESSOR CONTROLLING APPARATUS AND METHOD

(75) Inventors: Jaeyoo Yoo, Seoul (KR); Taewoong Nah, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 564 days.

(21) Appl. No.: 13/444,408

(22) Filed: Apr. 11, 2012

(65) Prior Publication Data

US 2012/0315153 A1 Dec. 13, 2012

(30) Foreign Application Priority Data

Jun. 13, 2011 (KR) ..... 10-2011-0057050

(51) Int. Cl.

| | |
|---|---|
| ***F04B 17/04*** | (2006.01) |
| ***F04B 35/04*** | (2006.01) |
| ***F04B 41/06*** | (2006.01) |
| ***F04B 49/06*** | (2006.01) |

(52) U.S. Cl.

CPC ..... *F04B 35/045* (2013.01); *F04B 41/06* (2013.01); *F04B 49/06* (2013.01); *F04B 2203/0401* (2013.01); *F04B 2203/0402* (2013.01); *F04B 2203/0404* (2013.01)

(58) Field of Classification Search

CPC ..... F04B 49/12; F04B 2203/04; F04B 2203/0401; F04B 2203/0402; F04B 17/03; F04B 17/04; F04B 35/04; F04B 35/045; F04B 23/04; F04B 23/06; F04B 41/06; F04B 49/06; F04B 49/065; F04B 201/0206; F04B 2203/0404; F04B 2207/01

USPC ..... 417/2, 44.11, 45, 216, 426

See application file for complete search history.

(56) References Cited

U.S. PATENT DOCUMENTS

| | | | | |
|---|---|---|---|---|
| 6,188,551 | B1 * | 2/2001 | Yoo | F25B 49/025 361/23 |
| 7,650,760 | B2 * | 1/2010 | Nakata | H02P 6/06 318/722 |
| 2003/0177773 | A1 * | 9/2003 | Kim | 62/156 |
| 2005/0123407 | A1 | 6/2005 | Schnetzka et al. | |
| 2006/0228221 | A1 * | 10/2006 | Heo | 417/2 |

(Continued)

FOREIGN PATENT DOCUMENTS

| | | | |
|---|---|---|---|
| CN | 1271992 | A | 11/2000 |
| CN | 1400388 | A | 3/2003 |

(Continued)

OTHER PUBLICATIONS

Machine Translation of Foreign Document: Publication No. KR1020050111283A; Application No. 10-2004-0036525; Publication date Nov. 2005: "Control Apparatus and Method for Multi Airconditioner in building".*

*Primary Examiner* — Charles Freay

(74) *Attorney, Agent, or Firm* — Dentons US LLP

(57) ABSTRACT

A machine includes at least two compressors that is controlled by a compressor controlling apparatus. By using an inverter for the at least two compressors, the use of elements is minimized and the compressor capacity may be increased, and the operation efficiency of the system may be enhanced. As an example, a plurality of operation modes may be used according to a load or cooling capacity of the two compressors. The two compressors are separately or simultaneously operated by using the inverter, thus simplifying the configuration of the system, and reducing cost.

20 Claims, 6 Drawing Sheets

(56) References Cited

U.S. PATENT DOCUMENTS

| | | | | |
|---|---|---|---|---|
| 2007/0056300 | A1 | 3/2007 | Crane | |
| 2009/0010766 | A1* | 1/2009 | Yoo et al. | 417/44.11 |
| 2009/0251086 | A1* | 10/2009 | Sekimoto et al. | 318/400.23 |

FOREIGN PATENT DOCUMENTS

| | | | |
|---|---|---|---|
| CN | 101351645 | A | 1/2009 |
| GB | 2246451 | A | 1/1992 |
| JP | 2001016898 | A | 1/2001 |
| JP | 2004-100640 | | 4/2004 |
| JP | 2000130824 | A | 5/2005 |
| KR | 10-2000-0002104 | | 1/2000 |
| KR | 1020050111283 | A * | 11/2005 |
| KR | 1020050111283 | A | 11/2005 |
| WO | WO 2009057873 | A2 * | 5/2009 |

* cited by examiner

MACHINE INCLUDING COMPRESSOR CONTROLLING APPARATUS AND METHOD

CROSS-REFERENCE TO RELATED APPLICATION

Pursuant to 35 U.S.C. §119(a), this application claims the benefit of earlier filing date and right of priority to Korean Application No. 10-2011-0057050, filed on Jun. 13, 2011, the contents of which is incorporated by reference herein in its entirety.

BACKGROUND

1. Field of the Disclosure

The present disclosure relates to machines including a compressor controlling apparatus for controlling at least two compressors by using, for example, an inverter, and a controlling method thereof.

2. Description of the Related Art

In general, a compressor is a device for converting mechanical energy into compression energy of a compressive fluid, and is used in various machines. For example, machines using a compressor include a refrigerator, an air-conditioner, or the like.

The compressor may be divided into a reciprocating compressor, a rotary compressor, and a scroll compressor. In the reciprocating compressor, a compression space is formed between a piston and a cylinder, in which operation gas is sucked into or discharged from, and the piston linearly and reciprocally moves within the cylinder to compress refrigerant. In the rotary compressor, a compression space is formed between an eccentrically rotating roller and a cylinder, in which operation gas is sucked into or discharged from, and the roller eccentrically rotates along an inner wall of the cylinder to compress refrigerant. In the scroll compressor, a compression space is formed between an orbiting scroll and a fixed scroll, in which operation gas is sucked into or discharged from, and the orbiting scroll rotates along the fixed scroll to compress refrigerant.

The reciprocating compressor sucks, compresses, and discharges the refrigerant by linearly and reciprocally moving the internal piston within the cylinder. The reciprocating compressor may be divided into a recipro-type reciprocating compressor and a linear type reciprocating compressor according to how a piston is driven.

The recipro-type reciprocating compressor couples a crank shaft to a motor that rotates and couples a piston to the crank shaft to convert a rotational movement of a motor into a linear, reciprocal movement. Meanwhile, the linear type reciprocating compressor connects a piston to an actuator of a motor that linearly moves and reciprocates the piston by the linear movement of the motor.

The reciprocating compressor includes an electric motor unit generating driving force and a compression unit compressing a fluid upon receiving the driving force from the electric motor unit. As the electric motor unit, generally, a motor is commonly used, and the linear type reciprocating compressor uses a linear motor.

The linear motor directly generates linear driving force by itself, without the need of a mechanical conversion device, and thus its structure is not complicated. Also, the linear motor can reduce loss resulting from energy conversion, and since it does not have a connection portion which may cause a frictional contact or may be abraded, noise can be considerably reduced. Also, when the linear type reciprocating compressor (referred to as a 'linear compressor', hereinafter) is used, for example, in a refrigerator or an air-conditioner, a compression ratio can be changed by changing a stroke voltage applied to the linear compressor, so that it can be used to control varying a cooling capacity.

Meanwhile, in the reciprocating compressor, in particular, in the linear compressor, the piston reciprocally moves without being mechanically restrained, so if a voltage is abruptly excessively applied, the piston may collide with a wall of the cylinder or the piston may not advance due to a large load, thereby failing to properly perform compression. Thus, a controlling apparatus for controlling the operation of the piston with respect to the change in the load or the voltage is desirable.

As an example, a compressor controlling apparatus detects voltage and current applied to a compressor motor and estimates a stroke according to a stroke sensorless method to perform feedback controlling. At this time, the compressor controlling apparatus uses a triac or an inverter in order to control a compressor. The compressor controlling apparatus employing an inverter controls only a single compressor by using a single inverter.

SUMMARY

An aspect of the disclosure provides a machine including a compressor controlling apparatus and method capable of separately or simultaneously operating at least two compressors by using an inverter.

Another aspect of the disclosure provides a machine including a compressor controlling apparatus and method capable of separately detecting currents and voltages applied to motors of at least two compressors and estimating strokes of the respective compressors to separately control the strokes or frequencies of the at least two compressors.

In another aspect of the disclosure, there is provided a machine including a compressor controlling apparatus including: an inverter including a plurality of switching elements and to switch direct current (DC) power into driving power for at least one of the first compressor and the second compressor according to a control signal; and a controller to generate the control signal for switching the plurality of switching elements and outputting the control signal to the inverter.

In another aspect, there is provided machine including a compressor controlling device including: a converter converting alternating current (AC) power into DC power; a smoothing unit smoothing the DC power; at least three inverter modules, at least one or more of the three inverter modules including two switching elements converting the smoothed DC power into compressor driving power according to a driving signal that activates one or more switching elements in the at least one or more of the three inverter modules to output the compressor driving power; a driving unit switched according to a control signal to generate the driving signal that activates one or more of the respective switching elements; and a controller generating the control signal according to received information regarding a state of the first and second compressors.

The machine including a compressor controlling apparatus according to the foregoing embodiments may simultaneously operate first and second compressors or separately operate the first and second compressors.

The machine including a compressor controlling apparatus according to the foregoing embodiments may further include: first and second current detection units detecting a compressor motor current applied to the motors provided in the respective first and second compressors; and first and second voltage detection units detecting a compressor motor voltage applied to each of the motors.

The machine including a compressor controlling apparatus according to the foregoing embodiments may further include: first and second stroke calculation units calculating first and second strokes of the first and second compressors by using the compressor motor current and the compressor motor voltage.

According to the embodiments of the disclosure, since the operation of two compressors is controlled by using a single inverter, the use of elements is minimized, the compressor capacity can be increased, and the operation efficiency of the system can be enhanced.

Also, according to the embodiments of the disclosure, a plurality of operation modes can be used according to a load or cooling capacity of the two compressors. Also, since two compressors are separately or simultaneously operated by using the single inverter, the configuration of the system can be simplified and the cost can be reduced.

The foregoing and other objects, features, aspects and advantages of the present invention will become more apparent from the following detailed description of the present invention when taken in conjunction with the accompanying drawings.

DETAILED DESCRIPTION OF THE EMBODIMENTS

Figure 1:
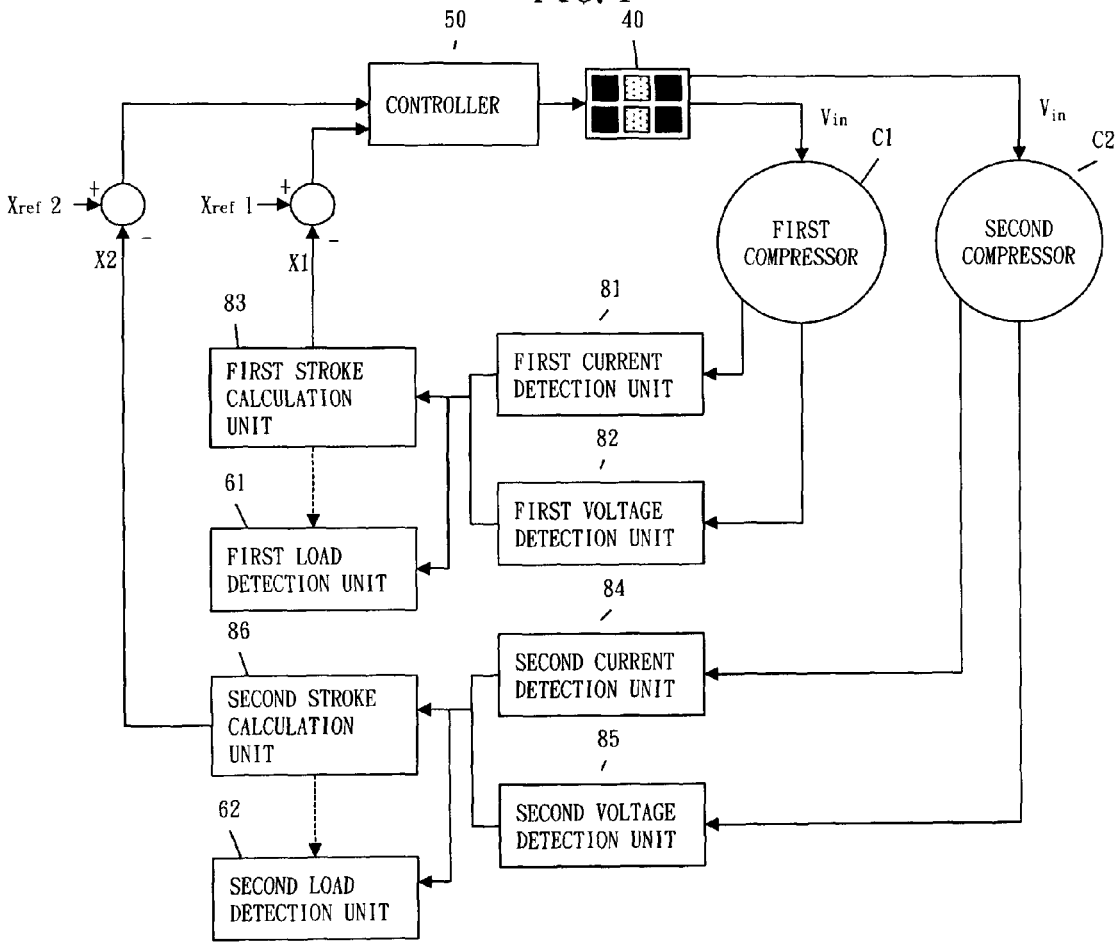
FIG. 1 is a view schematically showing a compressor controlling apparatus according to an embodiment of the present invention.

Embodiments of the present invention relate to a machine including a compressor controlling apparatus for controlling a stroke, a voltage, or a frequency of a compressor motor. The compressor controlling apparatus according to embodiments of the present invention simultaneously operates first and second compressors or individually operates the first and second compressors by using a single inverter.

First, the configuration of a reciprocating compressor, in particular, a linear compressor, to which the compressor controlling apparatus according to one or more embodiments of the present invention are applicable, will be briefly described. Here, some of the components in the configuration of the linear compressor may be modified or deleted, or any other components may be added.

In a linear compressor, an inlet pipe and an outlet pipe, to or from which refrigerant is introduced or discharged, are installed at one side of a hermetic container, and a cylinder is fixed within the hermetic container. In order to compress refrigerant sucked into a compression space within the cylinder, a piston is installed to reciprocally and linearly move within the cylinder. Also, springs are installed in a direction in which the piston moves, and supported by elastic force. The piston is connected with a linear motor generating linear reciprocal driving force, and the linear motor controls a stroke of the piston to change compression capacity. A suction valve is installed at one end of the piston in contact with the compression space, and a discharge valve assembly is installed at one end of the cylinder in contact with the compression space. Here, the suction valve and the discharge valve assembly are automatically controlled to open and close according to internal pressure of the compression space. The interior of the hermetic container is hermetically sealed as upper and lower shells are coupled together, and the inlet pipe to which a refrigerant flows and the outlet pipe from which the refrigerant flows out are installed at one side of the hermetic container. The piston is elastically supported in the direction in which the piston moves reciprocally and linearly within the cylinder. A linear motor is assembled to an outer side of the cylinder by a frame to constitute an assembly. The assembly is elastically supported by an inner bottom surface of the hermetic container by means of a support spring. Certain oil exists on the inner bottom surface of the hermetic container. An oil supply device for pumping oil is installed at a lower side of the assembly within the frame, and an oil supply pipe for supplying oil between the piston and cylinder is formed within the frame at a lower side of the assembly. The oil supply device may pump oil upon being operated by reciprocation generated as the piston reciprocally and linearly moves. The oil is supplied to a gap between the piston and the cylinder along the oil supply pipe, thereby performing a cooling and lubricating operation.

The cylinder is formed to have a hollow shape to allow the piston to reciprocally and linearly move therein, and the compression space is formed at one side of the cylinder. One end of the cylinder is positioned to be close within the inlet pipe and installed on the same straight line as the inlet pipe. Of course, the piston is installed to reciprocally and linearly move (or to make a reciprocal or linear movement) at the inner side of the cylinder close to the inlet pipe, and the to discharge valve assembly is installed at one end opposed to the inlet pipe. The discharge valve assembly includes a discharge cover forming a certain discharge space of the cylinder, a discharge valve opening and closing one end of the compression space side of the cylinder, and a valve spring, which may be a type of coil spring, providing elastic force in an axial direction and formed between the discharge cover and the discharge valve. Here, an O-ring is provided at the inner circumference of one end of the cylinder, and the discharge valve is tightly attached to one end of the cylinder. A loop pipe formed to be bent is connected between one side of the discharge cover and the outlet pipe. The loop pipe guides compressed refrigerant so as to be discharged to the outside, and buffers transmission of vibration to the entire hermetic container according to interaction of the cylinder, piston, and the linear motor. A refrigerant flow path is formed at the piston to allow refrigerant introduced from the inlet pipe to flow therealong. One end of the piston close to the inlet pipe is directly connected to the linear motor by a connection member, and a suction valve is installed at one end of the piston at the opposite side of the inlet pipe, and the piston is installed to be elastically supported by various springs in the movement direction of the piston. Here, the suction valve has a shape of a thin film plate and is formed such that a central portion thereof is partially cut to open and close the refrigerant flow path of the piston. One side of the suction valve is fixed at one end of the piston by a screw.

When the pressure in the compression space is lower than a certain suction pressure and lower than a discharge pressure according to the reciprocal, linear movement of the piston within the cylinder, the suction valve is opened to allow the refrigerant to be sucked into the compression space, and when the pressure in the compression space is higher than the certain suction pressure, the suction valve is closed and the refrigerant in the compression space is compressed.

The linear motor includes an inner stator configured by laminating a plurality of laminations in a circumferential direction and fixedly installed at an outer side of the cylinder by a frame, an outer stator configured by laminating a plurality of laminations in a circumferential direction in the vicinity of a coil winding body configured to allow coil to be wound therearound, and installed to be spaced apart from the inner stator at an outer side of the cylinder by a frame, and a permanent magnet positioned at a space between the inner stator and the outer stator and connected to the piston by a connection member. Here, the coil winding body may be fixed to an outer side of the inner stator. In the linear motor, when a current is applied to the coil winding body, electromagnetic force is generated, which causes the permanent magnet to reciprocally and linearly move according to interaction of the generated electromagnetic force and the permanent magnet, and the piston connected with the permanent magnet reciprocally and linearly moves within the cylinder.

With reference to FIG. 1, a compressor controlling apparatus according to an embodiment of the present invention includes a single inverter 40 having a plurality of switching elements and converting DC power into compressor driving power according to a control signal, and a controller 50 generating a control signal for driving the plurality of switching elements and outputting the control signal to the inverter 40. The compressor controlling apparatus according to an embodiment of the present invention may simultaneously operate a first compressor C1 and a second compressor C2 or separately operate the first and second compressors. This may be simply defined as a compressor operation to mode. The compressor mode is an operation mode determined by a load or a required cooling capacity of the first and second compressors. The compressor operation mode may be an operation mode for controlling by discriminating strokes, frequencies, or the like, of the respective compressors by a certain value. In the present embodiment, the compressor operation mode may be divided into a separate operation mode of the first compressor, a separate operation mode of the second compressor, and a simultaneous operation mode of the first and second compressors. Here, the control signal is generally a pulse width modulation (PWM) signal for controlling a PWM voltage duty with respect to the switching elements of the inverter 40.

Figure 2:
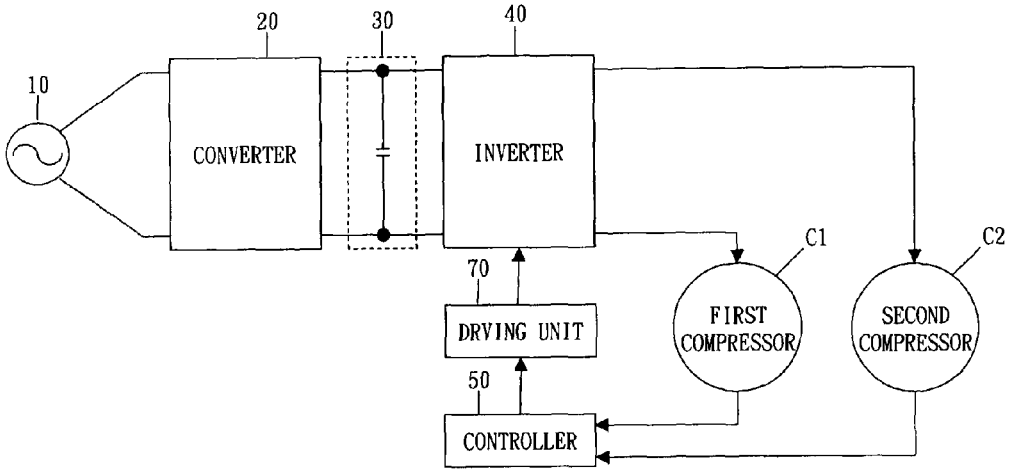
FIG. 2 is a view schematically showing a compressor controlling apparatus according to another embodiment of the present invention.

With reference to FIG. 2, a compressor controlling apparatus according to another embodiment of the present invention includes a converter 20 converting commercial AC power 10 into DC power, a smoothing unit 30 smoothing DC power, an inverter 40 having three inverter modules each comprised of two switching elements, converting the smoothed DC power into compressor driving power according to a driving signal with respect to each switching element, and outputting the same, a driving unit 70 switched according to a control signal to generate driving signals with respect to the switching elements; and a controller 50 generating the control signal according to information regarding a state of the first compressor and the second compressor. The compressor controlling apparatus may simultaneously operate the first and second compressors and separately or individually operate the first and second compressors. Here, in general, the control signal may be a PWM signal for controlling a PWM voltage duty with respect to the switching elements of the inverter 40.

Although not shown in FIG. 2, with reference to FIG. 1, the compressor to controlling apparatuses according to one or more embodiments of the present invention may include a first current detection unit 81 for detecting a compressor motor current applied to a compressor motor provided in the first compressor C1 and a first voltage detection unit 82 detecting a compressor motor voltage applied to the compressor motor. Also, the compressor controlling apparatuses according to one or more embodiments of the present invention may further include a second current detection unit 84 for detecting a compressor motor current applied to a compressor motor provided in the second compressor C2 and a second voltage detection unit 85 detecting a compressor motor voltage applied to the compressor motor.

The first and second current detection units 81 and 84 detect a driving current applied to the compressor according to a load of the compressor or a load of a refrigerating system, for example. The current detection units 81 and 84 detect a motor current applied to the compressor motor. The first and second voltage detection units 82 and 85 detect a driving voltage applied to the compressor. The voltage detection units 82 and 85 detect a motor voltage applied to both ends of the compressor motor according to a load of the compressor.

Although not shown in FIG. 2, with reference to FIG. 1, when the compressor is a reciprocating compressor, such as a linear compressor, the compressor controlling apparatuses according to one or more embodiments of the present invention further include first and second stroke calculation units 83 and 86 calculating first and second stroke of the first and second compressors by using the compressor motor current and the compressor motor voltage. The relationship among the motor voltage, the motor current, and the strokes is as follows. The first and second stroke calculation units 83 and 86 may calculate strokes by using Equation 1 shown below based on the motor voltages detected through the first and second voltage detection units 82 and 85 and the motor currents detected through the first and second current detection units 81 and 84.

$$x = \frac{1}{\alpha}\int\left(Vm - Ri - L\frac{di}{dt}\right)dt \qquad \text{[Equation 1]}$$

Here, x is a stroke, $\alpha$ is a motor constant, Vm is motor voltage, R is resistance, L is inductance, and i is motor current.

The controller 50 receives a first stroke reference value xref1 and compares a first stroke estimate value x1 calculated by the first stroke calculation unit 83 and a first stroke reference value. Upon comparing the first stroke estimate value and the first stroke reference value, the controller 50 generates a control signal according to the comparison results. Also, the controller 50 receives a second stroke reference value (or first stroke reference value) xref2 and compares a second stroke estimate value x2 calculated by the second stroke calculation unit 86 and a second stroke reference value. Upon comparing the second stroke estimate value and the second stroke reference value, the controller 50 generates a control signal according to the comparison results. The driving unit 70 selects switching elements connected to the first compressor or switching elements connected to the second compressor according to the control signals, and generates corresponding driving signals. The driving unit 70 is a switching circuit or element for switching the switching elements within the inverter. The compressor controlling apparatuses according to one or more embodiments of the present invention perform sensorless controlling, and a detailed description thereof will be omitted.

The compressor controlling apparatuses according to one or more embodiments of the present invention include first and second load detection units (61,62) for detecting a load of each of the first and second compressors by using the compressor motor current, the compressor motor voltage, and the first and second strokes. The controller 50 may simultaneously or separately operate the first and second compressors based on a load with respect to the first and second compressors.

The size of the load of the compressors may be detected by using, for example, a phase difference between the motor current and the stroke estimate value, and a phase difference between the motor voltage and the stroke estimate value. Also, the size of the compressor load may be detected by using a gas spring constant Kg. Various springs are installed to elastically support the piston in a movement direction within the compressor when the piston reciprocally and linearly moves. In detail, a coil spring, a type of a mechanical spring, is installed to elastically support the hermetic container and the cylinder in the movement direction of the piston. Also, the refrigerant sucked into the compression space is operated by a gas spring. Here, the coil spring has a certain mechanical spring constant (Km), and the gas spring has a gas spring constant (Kg) varied according to a load. The natural frequency of the linear compressor is determined in consideration of the mechanical spring constant (Km) and the gas spring constant (Kg). A relationship between the natural frequency (fn), and the mechanical and gas spring constants (Km and Kg) is expressed by Equation 2 shown below:

$$f_n = \frac{1}{2\pi}\sqrt{\frac{K_m + K_g}{M}} \quad \text{[Equation 2]}$$

Here, fn is the natural frequency of the piston, Km is the mechanical spring constant, Kg is the gas spring constant, and M is the mass of the piston.

The gas spring constant can be calculated as expressed by Equation 3 shown below based on the motor current and the stroke estimate value.

$$K_g = \alpha\left|\frac{I(j\omega)}{X(j\omega)}\right|\cos(\theta_{i,x}) + M\omega^2 - K_m \quad \text{[Equation 3]}$$

Here, α is the motor constant, w is the operation frequency, Km is the mechanical spring constant, Kg is the gas spring constant, M is the mass of the piston, |I(jω)| is a current peak value of one period, and |X(jω)| is a stroke peak value of one period.

In another example, the size of a compressor load may also be detected by using a gas damping constant $C_g$. The gas damping constant $C_g$ can be calculated by using a phase difference between the stroke estimate value and the motor current (voltage) as expressed by Equation 4 shown below:

$$C_g = \frac{\alpha}{\omega}\left|\frac{I(j\omega)}{X(j\omega)}\right|\sin(\theta_{i,x}) \quad \text{[Equation 4]}$$

Here, α is the motor constant, w is the operation frequency, Cg is a gas damping constant, |I(jω)| is a current peak value of one period, and |X(jω)| is a stroke peak value of one period.

Also, the compressor controlling apparatuses according to one or more embodiments are able to control the operation frequency of each compressor. The controller 50 generates the control signal by using current operation frequencies of the first and second compressors and frequency reference values with respect to the current operation frequencies.

The first compressor C1 and the second compressor C2 are connected with two among the three inverter modules within the inverter 40. Namely, the first compressor C1 is connected with the switching elements S1, S2, S3, and S4, and the second compressor C2 is connected with the switching elements S3, S4, S5, and S6. Here, one of the three inverter modules is commonly connected with the first and second compressors. Namely, the switching elements S3 and S4 are commonly used by the first and second compressors.

Figure 3:
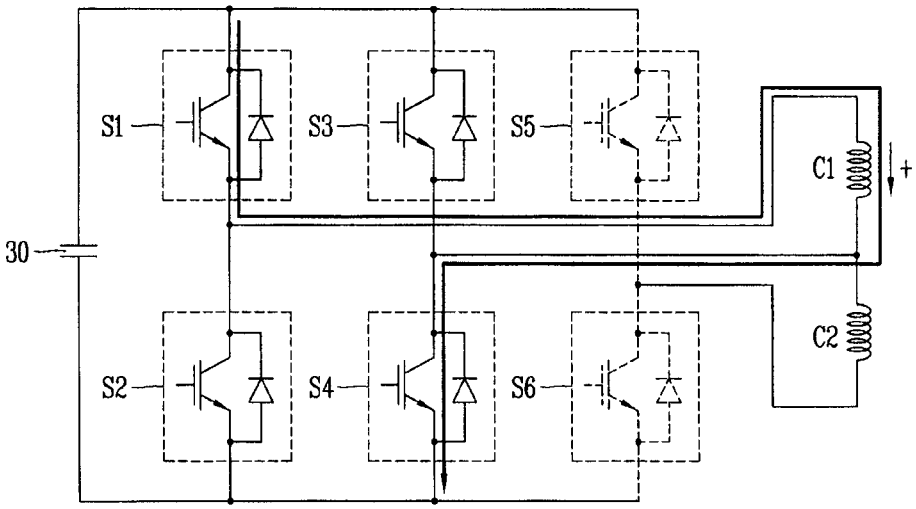
FIGS. 3 and 4 are views explaining a controlling operation of a first compressor among two compressors according to an embodiment of the present invention.
Figure 4:
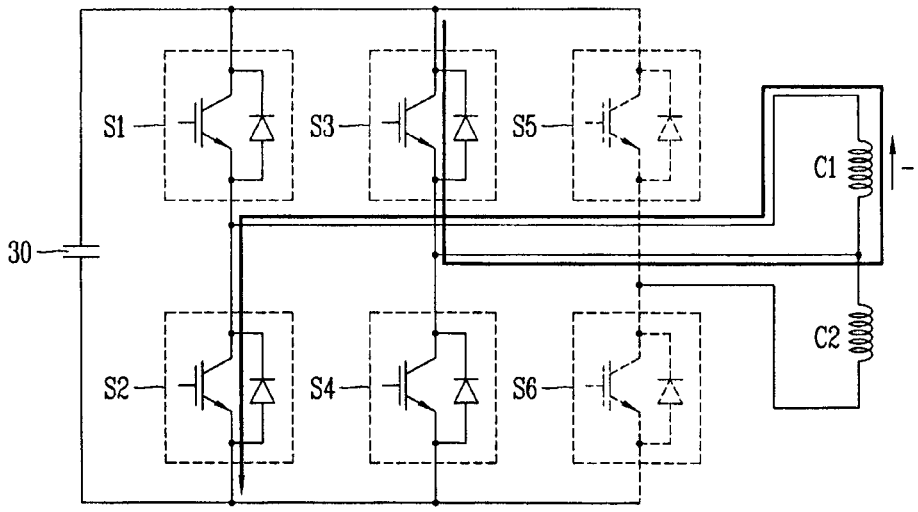

The controlling operation of the first compressor by using the switching elements S1, S2, S3, and S4 within the inverter 40 will now be described with reference to FIGS. 3 and 4. The first compressor C1 is connected with the switching elements S1, S2, S3, and S4 of the inverter 40. When the controller 50 generates a control signal for operating only the first compressor according to a compressor operation mode, the switching elements are driven according to the control signal. With reference to FIG. 3, a positive (+) current of the first compressor flows through the switching elements S1 and S4. Meanwhile, with reference to FIG. 4, a negative (−) current of the first compressor flows through the switching elements S2 and S3.

Figure 5:
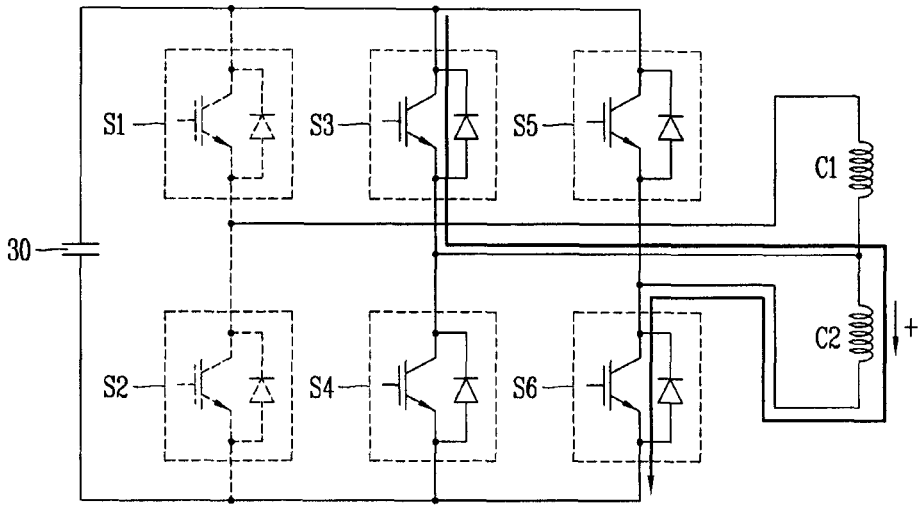
FIGS. 5 and 6 are views explaining a controlling operation of a second compressor among the two compressors according to an embodiment of the present invention.
Figure 6:
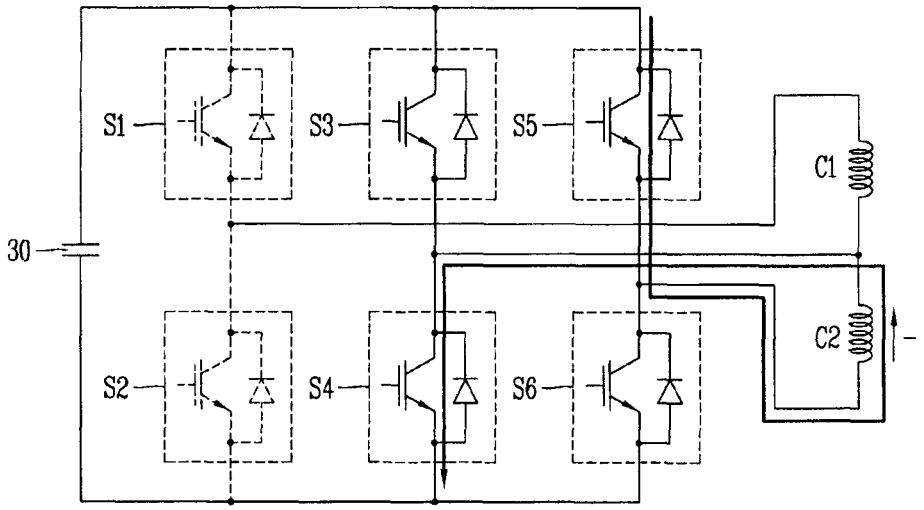

The controlling operation of the second compressor by using the switching elements S3, S4, S5, and S6 within the inverter 40 will now be described with reference to FIGS. 5 and 6. The second compressor C2 is connected with the switching elements S3, S4, S5, and S6 of the inverter 40. When the controller 50 generates a control signal for operating only the second compressor according to a compressor operation mode, the switching elements are driven according to the control signal. With reference to FIG. 5, a positive (+) current of the first compressor flows through the switching elements S3 and S6. Meanwhile, with reference to FIG. 6, a negative (−) current of the first compressor flows through the switching elements S4 and S5.

Figure 7A:
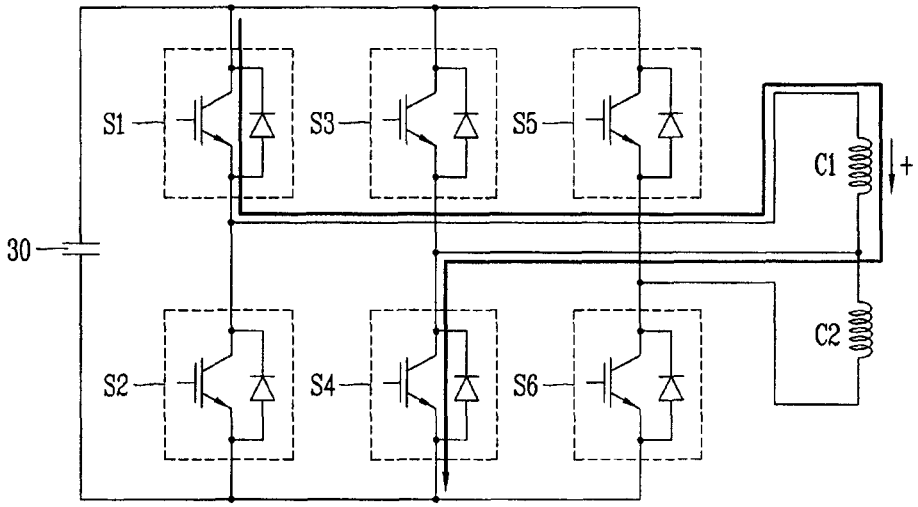
FIGS. 7A through 8B are views explaining simultaneously operating two to compressors according to an embodiment of the present invention.
Figure 7B:
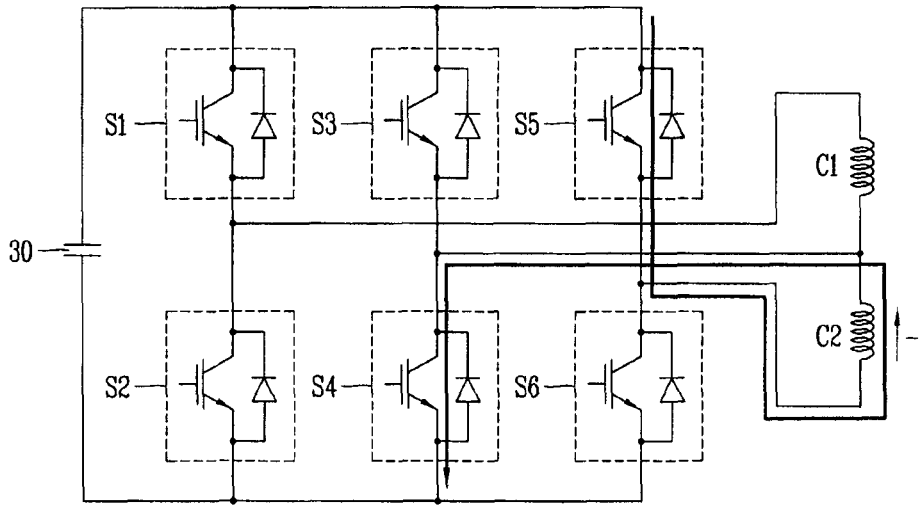
Figure 8A:
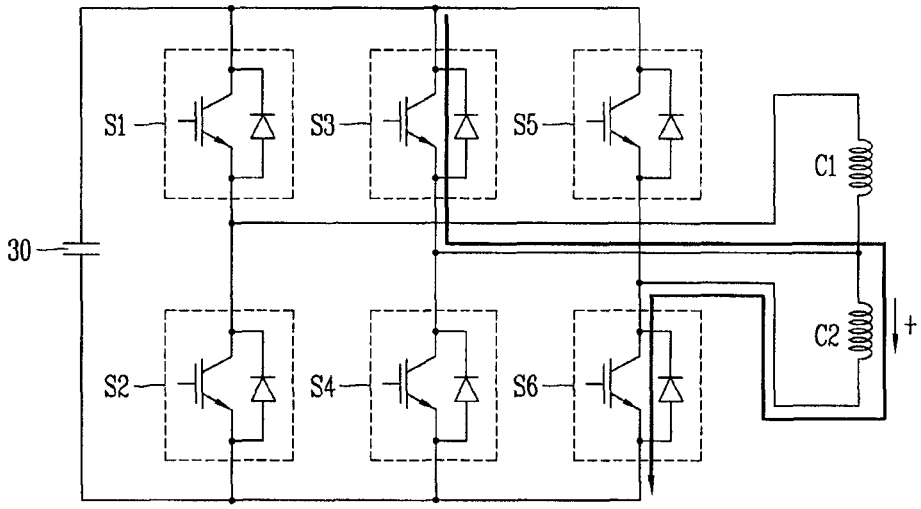
Figure 8B:
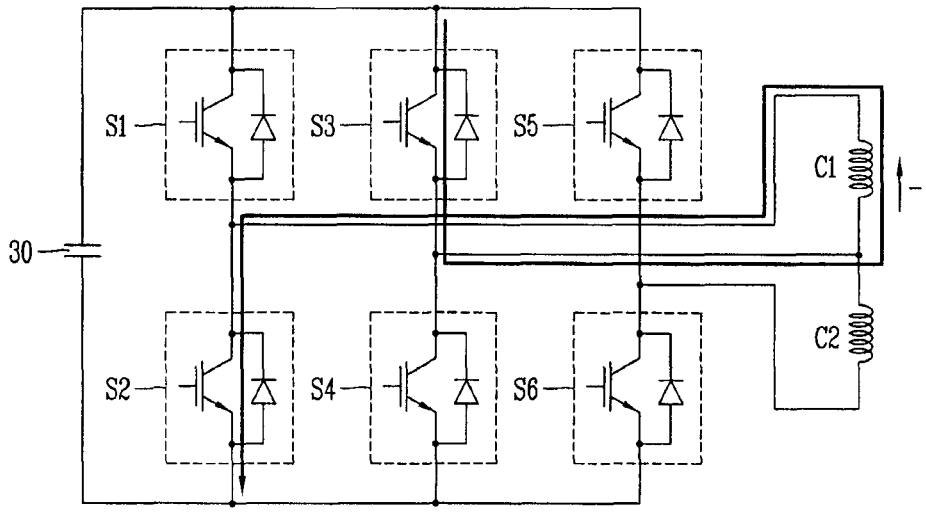

The controlling operation of the first and second compressors by using the switching elements S1, S2, S3, S4, S5, and S6 of the inverter 40 will now be described with reference to FIGS. 7A through 8B. Controlling of the positive (+) directional current of the first compressor C1 is performed by the switching element S1 (FIG. 7A), and controlling of the negative (−) directional current of the second compressor C2 is performed by the switching element S5 (FIG. 7B). Here, a common current flows through the switching element S4. Meanwhile, controlling of the negative (−) directional current of the first compressor C1 is performed by the switching element S2 (FIG. 8B), and controlling of the positive (+) directional current of the second compressor C2 is performed by the switching element S6 (FIG. 8A). Here, a common current flows through the switching element S3. Namely, as shown in FIGS. 7 and 8, the current directions flowing across the first and second compressors C1 and C2 are the opposite.

The current flows or controlling of the operation of the first and second compressors in FIGS. 3 through 8B may vary according to wirings (or connections) between the motors within the compressors and the switching elements within the inverter.

Figure 9:
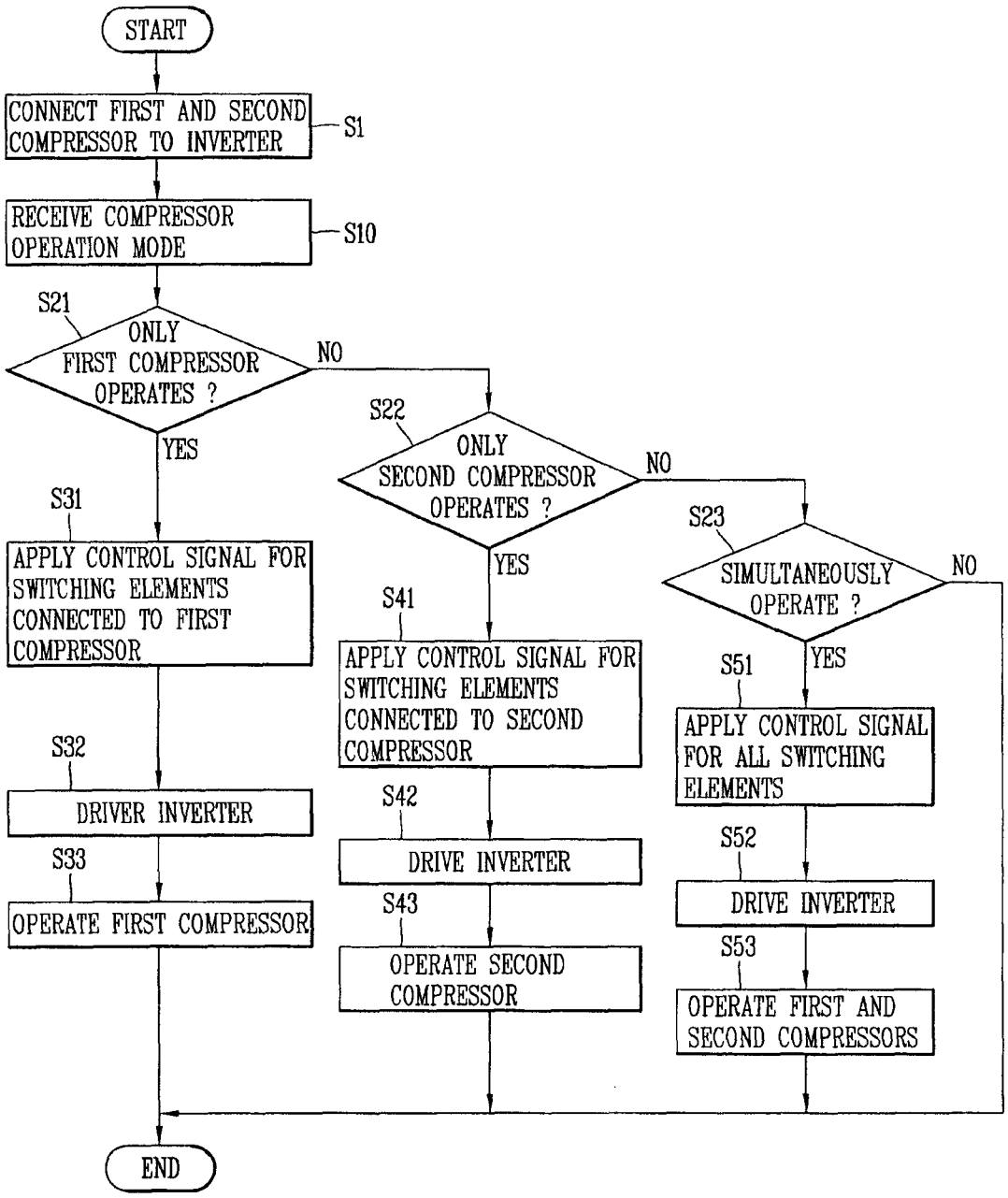
FIG. 9 is a flow chart schematically illustrating a compressor controlling method according to an embodiment of the present invention.

With reference to FIG. 9, in a compressor controlling method according to an embodiment of the present invention, the first and second compressors are controlled by using the inverter. The controlling method includes step (S10) of receiving a compressor operation mode and step (S21 to S53) of driving some or the entirety of the switching elements within the single inverter according to the compressor operation mode. Here, the compressor operation mode is an operation mode determined by a load of the first and second compressors, a required cooling capacity, or the like. In the compressor operation mode, the amount of compression, or the like, of each compressor may be controlled. The compressor operation mode may be simply divided into a mode for operating only the first compressor, a mode for operating only the second compressor, and a mode for simultaneously operating both the first and second compressors. The configuration of the apparatus hereinafter is referred to FIGS. 1 and 2.

The driving step may include steps (S31, S41, and S51) of inputting a control signal to some or the entirety of the switching elements within the single inverter and driving them. Also, the driving step may further include steps (S33, S43, and S53) of controlling the operation of the first compressor, the second compressor, or both first and second compressors connected to the driven switching elements.

First, the first and second compressors and the switching elements within the single inverter are connected (S1). The current flows or controlling of the operation of the first and second compressors in FIGS. 3 through 8B may vary according to wirings (or connections) between the motors within the compressors and the switching elements within the inverter. Next, whether to operate only the first compressor, whether to operate only the second compressor, or whether to simultaneously operate both the first and second compressors is determined according to a compressor operation mode (S21, S22, S23).

The controlling operation of the first compressor by using the switching elements S1, S2, S3, and S4 within the inverter 40 will now be described with reference to FIGS. 3 and 4 (S21). The first compressor C1 is connected with the to switching elements S1, S2, S3, and S4 of the inverter 40. When the controller 50 generates a control signal for operating only the first compressor according to a compressor operation mode (231), the switching elements are driven according to the control signal (S32). With reference to FIG. 3, a positive (+) current of the first compressor flows through the switching elements S1 and S4. Meanwhile, with reference to FIG. 4, a negative (−) current of the first compressor flows through the switching elements S2 and S3.

The controlling operation of the second compressor by using the switching elements S3, S4, S5, and S6 within the inverter 40 will now be described with reference to FIGS. 5 and 6 (S22). The second compressor C2 is connected with the switching elements S3, S4, S5, and S6 of the inverter 40. When the controller 50 generates a control signal for operating only the second compressor according to a compressor operation mode (S41), the switching elements are driven according to the control signal (S42). With reference to FIG. 5, a positive (+) current of the first compressor flows through the switching elements S3 and S6. Meanwhile, with reference to FIG. 6, a negative (−) current of the first compressor flows through the switching elements S4 and S5.

The controlling operation of the first and second compressors by using the switching elements S1, S2, S3, S4, S5, and S6 of the inverter 40 will now be described with reference to FIGS. 7A through 8B. Controlling of the positive (+) directional current of the first compressor C1 is performed by the switching element S1 (FIG. 7A), and controlling of the negative (−) directional current of the second compressor C2 is performed by the switching element S5 (FIG. 7B). Here, a common current flows through the switching element S4. Meanwhile, controlling of the negative (−) directional current of the first compressor C1 is performed by the switching element S2 (FIG. 8B), and controlling of the positive (+) directional current of the second compressor C2 is performed by the switching element S6 (FIG. 8A). Here, a common current flows through the switching element S3. Namely, as shown in FIGS. 7 and 8, the current directions flowing across the first and second compressors C1 and C2 are the opposite.

As described above, since the operation of two compressors is controlled by using a single inverter, the use of elements is minimized, the compressor capacity can be increased, and the operation efficiency of the system can be enhanced. Also, a plurality of operation modes can be used according to a load or cooling capacity by using two compressors. In addition, since two compressors are separately or simultaneously operated by using the single inverter, the configuration of the system can be simplified.

Furthermore, the embodiments of the disclosure have been described with the inverter and the controller being separate units. However, in another embodiments, the inverter and the controller may be a single unit. For example, the inverter and the controller may be formed using a custom semiconductor chip, application specific integrated circuit (ASIC), field programmable gate array (FPGA), and the like.

The controller may be a microprocessor, a circuit formed using logic gates, or any suitable processing module using hardware, software, and combination thereof.

What is claimed is:

1. A machine comprising:

a first compressor;

a second compressor;

a compressor controlling apparatus including, an inverter including a plurality of switching elements to switch direct current (DC) power into driving power for at least one of the first compressor and the second compressor according to a control signal; and a controller to generate the control signal for switching the plurality of switching elements and output the control signal to the inverter, wherein first and second compressors are simultaneously operated or separately operated based on the control signal, wherein some of the plurality of switching elements of the inverter are controlled based on the control signal when the first and second compressors are separately operated, wherein a first connection of the first compressor is connected with a first pair of switching elements, a first connection of the second compressor is connected with a second pair of switching elements, and a common connection of the first and second compressors is connected with the second pair of switching elements, wherein directions of current flowing through the first and second compressors are determined based on controlling of the switching elements.

2. The machine of claim 1, further comprising:

first and second current detectors to detect a compressor motor current applied to motors provided in the respective first and second compressors; and first and second voltage detectors to detect a compressor motor voltage applied to the respective motors.

3. The machine of claim 2, wherein the first and second compressors are reciprocating compressors, the machine further comprising:

first and second stroke calculators to calculate first and second strokes of the first and second reciprocating compressors by using the respective compressor motor current and compressor motor voltage.

4. The machine of claim 3, wherein the controller generates the control signal by using the first stroke and a stroke reference value with respect to the first reciprocating compressor.

5. The machine of claim 3, wherein the controller generates the control signal by using the second stroke and a stroke reference value with respect to the second reciprocating compressor.

6. The machine of claim 3, further comprising:

first and second load detectors to detect a load with respect to the first and second reciprocating compressors by using the compressor motor current, the compressor motor voltage, or the first and second strokes, wherein the load is detected based on a phase difference between the compressor motor current and a stroke estimate value, or a phase difference between the compressor motor voltage and the stroke estimate value.

7. The machine of claim 1, further comprising:

first and second load detectors, wherein both of the first and second compressors are simultaneously operated or the first and second compressors are separately operated based on the loads with respect to the first and second compressors detected by the first and second load detectors.

8. The machine of claim 1, wherein the controller generates the control signal by using current operation frequencies of the first and second compressors and frequency reference values with respect to the current operation frequencies.

9. The machine of claim 1, wherein the inverter includes at least three inverter modules and the first and second compressors are connected with two of the at least three inverter modules respectively.

10. The machine of claim 9, wherein one of the at least three inverter modules is commonly connected with the first and second compressors.

11. The machine of claim 3, wherein the first and second reciprocating compressors are linear compressors.

12. A compressor controlling method for controlling first and second compressors by using an inverter, the method comprising:

receiving a compressor operation mode;

driving the first compressor, the second compressor, or both the first and second compressors according to the compressor operation mode;

switching at least a part of a plurality of switching elements of the inverter when the compressor operation mode is an operation of the first compressor;

switching at least a part of the plurality of switching elements of the inverter when the compressor operation mode is an operation of the second compressor, wherein a first connection of the first compressor is connected with a first pair of switching elements, a first connection of the second compressor is connected with a second pair of switching elements, and a common connection of the first and second compressors is connected with the second pair of switching elements, wherein directions of current flowing through the first and second compressors are determined based on controlling of the switching elements.

13. The method of claim 12, further comprising:

switching all of the switching elements of the inverter when the compressor operation mode is an operation of the first and second compressors, wherein at least one of the switching elements are commonly connected to the first and second compressors.

14. A machine comprising:

a first compressor;

a second compressor;

a converter to convert alternating current (AC) power into direct current (DC) power;

a smoothing unit to smooth the DC power;

a compressor controlling device including, an inverter having at least three inverter modules, one of the three inverter modules including two switching elements to convert the smoothed DC power into compressor driving power according to a driving signal that activates one or more switching elements in the at least one or more of the three inverter modules to output the compressor driving power;

a driving unit to generate the driving signal that activates one or more of the respective switching elements based on a control signal; and a controller to generate the control signal according to received information regarding a state of the first and second compressors, wherein first and second compressors are simultaneously operated or separately operated based on the driving signal, wherein some of the at least three inverter module are controlled based on the control signal when the first and second compressors are separately operated, wherein a first connection of the first compressor is connected with one of three inverter modules, a first connection of the second compressor is connected with another of the three inverter modules, and a common connection of the first and second compressors is connected with the another of the three inverter modules, wherein directions of current flowing through the first and second compressors are determined based on controlling of the switching elements.

15. The machine of claim 14, further comprising:

first and second current detection units to detect a compressor motor current applied to motors provided in the respective first and second compressors; and first and second voltage detection units to detect a compressor motor voltage applied to the respective motors.

16. The machine of claim 15, wherein the first and second compressors are reciprocating compressors, the machine further comprising:

first and second stroke calculation units to calculate first and second strokes of the first and second reciprocating compressors by using the compressor motor current and the compressor motor voltage.

17. The machine of claim 16, further comprising:

first and second load detection units to detect a load with respect to each of the first and second reciprocating compressors by using the compressor motor current, the compressor motor voltage, or the first and second strokes, wherein the load is a reactionary force incurred on the first and second reciprocating compressors.

18. The machine of claim 14, further comprising:

first and second load detection units, wherein both of the first and second compressors are simultaneously operated or the first and second compressors are separately operated based on the loads with respect to the first and second compressors detected by the first and second load detection units.

19. The machine of claim 14, wherein the controller generates the control signal by using current operation frequencies of the first and second compressors and frequency reference values with respect to the current operation frequencies.

20. The machine of claim 14, wherein the first and second compressors are commonly connected with one of the three inverter modules respectively.

* * * * *